United States Patent [19]

Ellison

[11] Patent Number: 4,862,130

[45] **Date of Patent: * Aug. 29, 1989**

[54] WIRE CROSS-OVER ARRANGEMENT FOR ANGULAR COIL ASSEMBLY

[75] Inventor: Donald E. Ellison, St. Clair Shores, Mich.

[73] Assignee: United Technologies Automotive, Inc., Dearborn, Mich.

[ * ] Notice: The portion of the term of this patent subsequent to Jan. 20, 2004 has been disclaimed.

[21] Appl. No.: 74,109

[22] Filed: Jul. 16, 1987

[51] Int. Cl.[4] ..... H01F 27/30

[52] U.S. Cl. ..... 336/185; 336/192; 336/198

[58] Field of Search ..... 310/194; 336/192, 198, 336/208, 185; 242/117, 118, 118.41

[56] References Cited

U.S. PATENT DOCUMENTS

| | | | |
|---|---|---|---|
| 2,298,357 | 10/1942 | Elvin et al. | 336/208 X |
| 2,355,477 | 8/1944 | Stahl | 242/119 |
| 2,453,725 | 11/1948 | Price | 336/208 X |
| 3,117,294 | 1/1964 | Muszynski et al. | 336/192 |
| 3,189,857 | 6/1965 | Jones | 336/192 X |
| 3,661,342 | 5/1972 | Sears | 242/118.41 |
| 4,274,136 | 6/1981 | Onodera et al. | 363/68 |
| 4,363,014 | 12/1982 | Leach et al. | 336/192 X |
| 4,388,568 | 6/1983 | Goseberg et al. | 315/411 |
| 4,638,282 | 1/1987 | Ellison | 336/185 |

FOREIGN PATENT DOCUMENTS

83/00184 11/1983 World Int. Prop. O. .

*Primary Examiner*—Thomas J. Kozma

[57] ABSTRACT

A coil assembly, as for the secondary of a high voltage ignition transformer, includes a coil subdivided into segments in slots defined by radial flanges on a coil bobbin. The bobbin spindle is of a polygonal cross section, preferably having four axially-extending corners along its outer perimeter. Cross-over grooves provided in the bobbin flanges allow the coil wire transitioning from one slot to the next to be relatively isolated from contact with the multiple layers of coil-turns deposited in a slot. The angular geometry of the core spindle and the geometry and positioning of the cross-over grooves in the flanges is such as to afford relatively-easily molded grooves and wide slot widths relative to the thickness of the flanges in which the grooves are formed.

3 Claims, 3 Drawing Sheets

WIRE CROSS-OVER ARRANGEMENT FOR ANGULAR COIL ASSEMBLY

TECHNICAL FIELD

The invention relates generally to a coil assembly, such as a transformer coil assembly, and more particularly to a multiple slot bobbin used in such coil assemblies, particularly for high voltage applications.

BACKGROUND ART

Electrical coil assemblies exist for numerous applications. In one application, that of voltage step-up or step-down, an induced voltage of one potential in a primary coil is stepped-up or stepped-down by a secondary coil as a function of the turns ratio. High voltage transformers of relatively small size exist both in communications equipment, such as televisions and the like, and in ignition systems for automobiles and the like. In each instance a relatively low potential applied to a primary coil is stepped-up to a relatively high voltage, i.e. thousands of volts, by a secondary winding.

In the design of such high-voltage coil assemblies as exist in the secondary of an automotive ignition transformer, it is necessary to design against electrical shorting or arcing in order to ensure the long life and integrity of the coil. Because each coil-turn in the secondary develops a potential thereacross and because such high voltage secondaries may include a very large number of turns, and thus a large total potential across the entire coil, care must be taken to minimize electrical shorting between coil-turns. Normally, the wire used in winding a coil will include a thin, insulative coating which may be rated for several hundred volts. In the winding of such a coil, it is necessary that a coil-turn of a relatively low potential not be in contact with a coil-turn of a substantially higher potential. To this end, the bobbin structure for the secondaries of high voltage transformers have been provided with multiple slots which effectively provide numerous small coils of limited axial extent. Examples of such coil assemblies are depicted in U.S. Pat. No. 4,274,136 to Onodera et al; U.S. Pat. No. 4,388,568 to Goseberg et al and PCT Application No. DE83-00184 of Worz having International Publication No. WO84/02224.

By employing the winding configuration of the aforementioned patents, and assuming for example that each coil-turn develops a potential thereacross of five volts and that ten such coil-turns exist in a particular layer in each slot on the bobbin, then each adjacent coil-turn in a particular layer in a slot will differ by only five volts from that of the preceding or following coil-turn and the coil-turns in the layer immediately above or below will typically differ in potential by only about 50 volts.

While the provision of slots in the bobbin does provide a plurality of coils of limited axial extent and thus limited difference in the potential between successive layers of coil-turns within a slot, there remains the possible problem that the coil wire which normally transitions or crosses-over from the uppermost layer of coil-turns in one slot to the lowermost layer of coil-turns in the next adjacent slot will be placed in undesirable proximity or contact with some of the radially uppermost or outermost turns in the second slot which have a greatly different electrical potential. Moreover, even in situations in which the difference in electrical potential is far less, the insulating coating on the coil wire which crosses over from one slot to the next may be subjected to considerable abrasion by the coil windings as they are subsequently formed. The aforementioned U.S. Pat. No. 4,274,136 discloses the use of notches or recesses in the flanges which constitute the walls to the successive slots. These recesses extend axially the full way through a respective flange and radially from the outer surface of the bobbin spindle to the radially outer end of the flange. While the provision of such recesses does enable the coil wire to transition from one slot to the next, it does not appear to provide particularly good separation or isolation of the transitioning coil wire from either the outermost coil-turns in the slot into which it is transitioning or the inward coil-turns in the slot from which it is originating. In this latter regard, when the coil-turns are completed in one slot and the transition is made from that slot to the bobbin spindle in the next adjacent slot via the notched recesses of U.S. Pat. No. 4,274,136, there exists the possibility that the winding tension on the wire will cause the transitioning wire to be pulled radially downward between the coil and the flange of the slot from which it is transitioning. In such instance, it will be appreciated that the aforementioned problem is again created, however, in this instance in a reversed manner.

Examples of coil assemblies which do provide grooves in the flanges separating adjacent coil segments include U.S. Pat. No. 3,661,342 to Sears and U.S. Pat. No. 2,355,477 to Stahl. In U.S. Pat. No. 3,661,342 there is disclosed a rectangular core having rectangular flanges and a corresponding cross-over groove between successive slots on the bobbin. However, the cross-over slot is formed by a complex contouring of the flange which defines an "enclosed" cross-over path, such that the coil winding is trapped axially, or longitudinally, of the bobbin as it transitions from one slot to the next.

The U.S. Pat. No. 2,355,477 discloses a multi-slot coil form of circular or polygonal configuration. The flanges between successive slots on the coil form are provided with grooves (or slots 15) in which the windings transitioning from one slot to the next may lie. Those grooves (slots 15) are directly open in an axial direction. However, the depth of those grooves is shallow relative to the greater axial width of the slots.

As used in the present application, the term "slot" denotes the recess extending radially inward of the bobbin's perimeter and into which multiple coil-turns are deposited, and the term "groove" denotes the generally linear recess formed in a respective flange and which provides a cross-over path for a winding between successive slots.

Recently, U.S. Pat. No. 4,638,282 by Ellison and assigned to United Technologies Automotive, Inc., the same inventor and assignee as in the present application, disclosed an improved wire cross-over arrangement for a coil assembly. In that patent a cross-over groove of relatively simple axially-open construction is provided in the wall of successive flanges to define a cross-over path for the wire transitioning from one slot to the next. More specifically, that patent discloses a specific geometry involving both the cross-over grooves and the slots for accommodating a "worst-case" winding condition. Specifically, the slots are relatively narrow and the axial depth of the cross-over grooves is sufficiently deep that even if the lead wire from a supply spool is in contact with the interior face of the opposite flange during the initial turn in a slot, the wire will remain substantially entirely in the cross-over groove. This feature is highly desirable for the purpose of minimizing or eliminating contact of the transitioning coil with subsequent coil turns in a slot which may be of relatively higher potential. For the generally circular bobbin geometry described in that patent, to attain the aforementioned characteristic while retaining the full structural integrity of the separating flanges it was generally necessary that the axial thickness of a flange be substantially as great as the width of a slot or conversely, that the width of a slot be relatively narrow. A shortcoming in such construction resides in the relatively large amount of material required for the flanges and the relatively small remaining space for the slots in which the coil turns are deposited. This may increase the overall volume and/or cost of the product.

DISCLOSURE OF INVENTION

Accordingly it is a principal object of the invention to provide a coil assembly, particularly though not exclusively for high voltage applications, which minimizes the possibility of electrical shorting or breakdown between coil-turns. It is a further object of the invention to provide an improved coil assembly of the type employing a multiple-slot bobbin. It is a still further object of the invention to provide an improved coil assembly which maximizes the slot width available for coil turns relative to the material required for the separating flanges, yet which also preserves the desirable characteristics of a simple, axially-open cross-over groove of a geometry which addresses the "worst-case" winding condition.

According to the invention, there is provided an improved coil assembly of the type which includes a bobbin and a multi-turn winding of coil wire disposed on the bobbin. The bobbin includes a central spindle and a plurality of axially-spaced annular flanges extending from the spindle to define a plurality of respective slots between facing surfaces of adjacent pairs of the flanges. The winding is disposed in multiple layers in the respective slots on the bobbin and is continuous between successive slots in which it is disposed. One flange of each pair of the flanges between which the winding is disposed include a cross-over groove formed in the facing surface thereof for receiving the coil wire which transitions from one slot to another. The diameter of the coil wire is much less than the axial width of a slot. The cross-over groove is directly axially open to the slot into which the coil wire is transitioning and is of a width and depth in the respective flange such as to receive the full diameter of the coil wire therewithin throughout the extent of the groove while also preserving the separation function of the flange. This minimizes or prevents contact of the coil wire transitioning into a slot with the radially-outward winding subsequently deposited in that slot and also with the radially inward windings in the slot from which it is transitioning.

The improvement specifically includes the bobbin spindle being of polygonal cross section having an outer perimeter which includes at least three axially-extending corners. Moreover, the thickness of respective flanges in the longitudinal, or axial, direction is less than the width of respective slots in that same direction, and a respective cross-over groove extends from a position near the radially-outer edge of the respective flange in an inward direction substantially tangent to the bobbin spindle and to a position of substantial coincidence with a corner of the bobbin spindle. Still further, the remaining geometry and positioning of the cross-over grooves relative to the geometry of the respective flanges is such that the coil wire necessarily lies within the respective grooves for substantially the full length of the grooves, even under so-called "worst-case" winding conditions.

The bobbin spindle is preferably of rectangular cross section and the contour of the perimeter of the respective flanges conforms substantially to the contour of the perimeter of the bobbin spindle. Further, the cross-over grooves are preferably positioned to be of minimum possible length or extent from the perimeter of the flange to their tangency with the bobbin spindle at a respective corner. This is conveniently provided in the preferred embodiment by orienting the cross-over groove to extend substantially coplanar with the planar surface of the bobbin perimeter which extends from the corner with which the groove is coincident to the next adjacent corner in the direction in which the coil is wound. By providing a pair of such cross-over grooves, a respective one of the grooves being at a respective one of a pair of adjacent corners of the bobbin, it is possible to accommodate winding of the coil in either direction. Further, the transition of the coil wire from one slot into the groove of the next slot is guided by at least one, and possibly two, radially-outwardly extending ridges at the radially-outward end of a respective flange and disposed angularly to the side of the cross-over groove.

In a further embodiment, the cross-over groove is disclosed as being inclined to the planar surface of the spindle, though still being tangential to the spindle at a corner. A pair of guide ridges are disposed to angularly opposite sides of the entry to the cross-over groove.

BEST MODE FOR CARRYING OUT THE INVENTION

Figure 1:
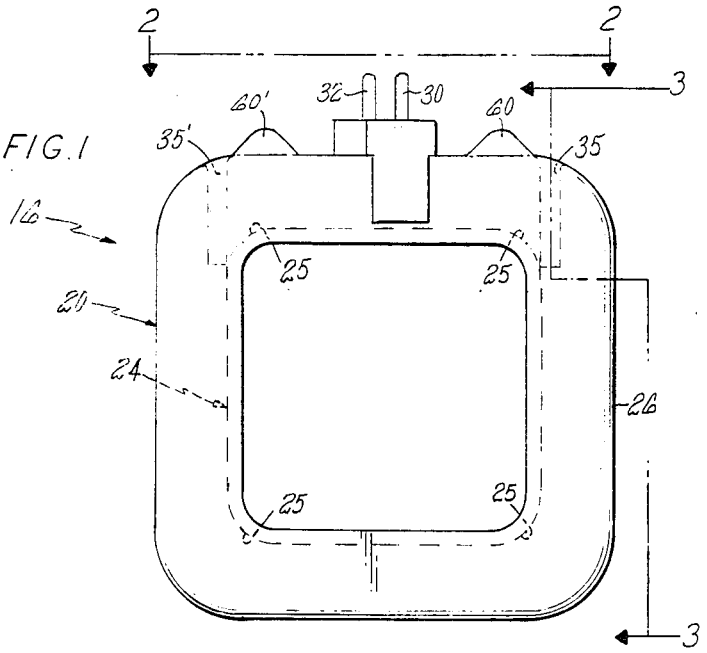
FIG. 1 is a view of a first embodiment of the coil assembly of the invention.
Figure 2:
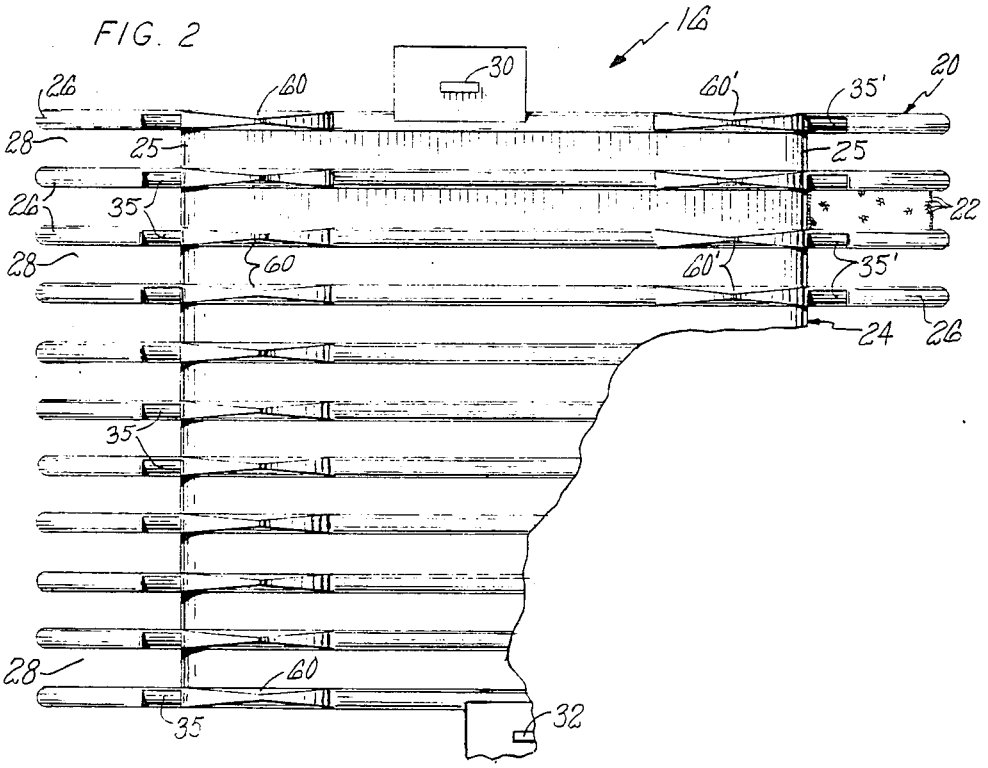
FIG. 2 is a view of the coil assembly taken along line 2—2 of FIG. 1.

Referring to FIGS. 1-4, there is illustrated a coil assembly 16 in accordance with a first embodiment of the invention. Coil assembly 16 may typically provide the secondary of a high voltage ignition transformer as used for automotive ignition. The coil assembly 16 may typically be concentrically disposed about a respective primary coil assembly (not shown). A laminated core (not shown) may extend through the center of the primary and secondary coil assemblies. In a representative embodiment, the potential across the terminals of the secondary coil assembly may be in the neighborhood of 40,000 volts. For a further understanding of the use of coil assembly 16 as the secondary in a high voltage automotive ignition transformer, reference may be made to the aforementioned U.S. Pat. No. 4,638,282.

The coil assembly 16 includes a bobbin 20 of insulating material on which is formed a multi-turn winding of insulated coil wire 22. The number of turns may typically be in the range of 10,000–20,000. The bobbin 20 is formed of a suitable rigid plastic and includes a tubular spindle portion 24 of polygonal cross section having an outer perimeter including three or more corners 25 extending longitudinally, or axially, thereof. In the illustrated embodiment, the bobbin spindle 24 is rectangular and specifically, square, and thus contains four corners 25 disposed at 90° intervals about the centerline or axis of the bobbin 20.

Because of the relatively high electrical potential associated with the coil assembly 16, the bobbin 20 is axially segmented by the provision of a series of annular, axially-spaced flanges 26 which are integral with and extend transversely, or radially, outward from the bobbin spindle 24 to form respective slots 28 therebetween. The contour of the perimeter of the flanges 26 corresponds with that of the perimeter of spindle 24. In the illustrated embodiment, the bobbin 20 may be provided with ten equally-sized slots 28 defined by eleven flanges 26. Approximately 1100 turns of coil wire 22 are disposed in each of the slots 28, with a somewhat lesser number of turns being provided near the end and a somewhat greater number of turns inwardly thereof. The coil wire 22 including its insulating coating, may typically have a diameter of about 0.002 inch and the width $W_S$ of a respective slot 28 may typically be about 0.060 inch such that approximately 30 coil-turns may be wound in a single layer of common radius within a particular slot. Thus, there may be 30 or more layers of such windings within a respective slot 28. The difference in electrical potentials between radially inner and outer layers of windings of wire 22 in a particular slot 28 may be several thousand volts.

Each bobbin 20 is provided with a pair of tie-off terminals 30 and 32 disposed at opposite ends of the coil assembly 16. In accordance with the present embodiment of the invention, the coil wire 22 may be wound on the bobbin 20 in either direction such that either tie-off terminal 30 or 32 may represent the beginning of the coil winding and the other would then represent the end.

In accordance with the invention, there is provided at least one cross-over groove 35 formed in the interior wall of one flange 26 of each pair which define a respective slot 28. In the embodiment depicted in FIGS. 1–4, the bobbin 20 is provided with two such cross-over grooves 35 and 35' associated with each slot 28 to facilitate winding the coil assembly 16 in either direction as will be hereinafter described. The cross-over grooves 35, 35' are formed in the interior wall of each flange 26 that is followed by a respective slot 28. The cross-over grooves 35 are utilized during the winding of coil wire 22 in a clockwise direction about the bobbin 20 as represented in FIG. 1. Conversely, the cross-over grooves 35' are utilized when the coil wire 22 is wound on bobbin 20 in a counterclockwise direction as viewed in FIG. 1. Obviously, the coil wire may be deposited on the bobbin 20 by rotating the bobbin relative to the coil wire 22, in which case the direction of rotation of the bobbin 20 is reversed. Each cross-over groove 35 or 35' facilitates the transition of the coil wire from the top of a completed winding in a preceding slot 28 into the next adjacent slot 28 and more specifically, to the spindle 24 of bobbin 20 to begin the winding process in that slot.

Importantly, a cross-over groove 35 or 35' is structured so as to facilitate the avoidance of contact of the transitioning coil wire 22 entering a slot 28 with the later-completed coil-turns of the winding in that slot. This minimizes or eliminates abrasion of the insulating coating on the transitioning coil wire 22 and thus is desirable even for coil assemblies of relatively lower voltage ranges. Moreover, for a high voltage coil assembly it minimizes the possibility of breakdown or arcing in the region of the coil-turns which are positioned relatively toward the radially-outward end of the slot. The grooves 35, 35' have a depth $D_G$ (seen in FIGS. 3 and 4) in the axial direction into a flange 26 and a corresponding width $W_G$ (seen in FIG. 4) transverse thereto. Both the depth $D_G$ and the width $W_G$ of the grooves 35, 35' are sufficient to receive the full diameter of the coil wire 22 (0.002 inch) therewithin over its length.

In accordance with the invention, the cross-over grooves 35, 35' extend from respective positions at the radially-outer edge of a respective flange 26 in a direction which is substantially tangential to the outer perimeter of the bobbin spindle 24. Since the outer perimeter of the bobbin spindle 24 includes four corners, each interconnected by a respective flat, or planar, surface, the cross-over grooves 35 and 35' are also inherently tangential with a respective corner of the spindle 24 and their respective innermost ends are substantially coincident with those same corners. Since it is desirable to avoid sharp edges at the corners 25 of the spindle 24 to minimize stressing of the coil winding 22 and promote appropriate seating thereof, the corners 25 are provided with a small radius to facilitate the 90° transition from one plane to the next. Thus, each of the corners 25 of the spindle 24 is represented by an axially-extending arcuate surface, and the cross-over grooves 35, 35' are tangent to a respective pair of those corners. The two cross-over grooves 35 and 35' associated with a respective slot 28 are preferably not associated with the same corner, but may conveniently be associated with a pair of adjacent corners 25 on the spindle 24. Such arrangement of grooves 35, 35' facilitates the molding operation, places them relatively close to the appropriate tie-off terminal 30 or 32 also positioned intermediate that particular pair of adjacent corners, and thus groups to one side of coil assembly 16 all parts extending outward of flange 26, thereby facilitating design of a housing.

Although the cross-over grooves 35, 35' might have a uniform depth $D_G$ throughout their length, it will be advantageous to gradually decrease that depth substantially to zero in the direction toward the point of tangency with the bobbin spindle 24 at a respective corner 25. Such arrangement allows continued support of the coil wire 22 by the base of the cross-over groove 35 or 35' throughout its length and further ensures the structural integrity of the respective flange 26 in which it is formed. It will be noted that although the groove 35 has a substantial depth $D_G$ at its "entering" end, it nonetheless preserves the integrity of the respective flange 26. Importantly also, the base or root of each cross-over groove 35, 35' is sufficiently continuous along its length that the coil wire 22 transitioning from a preceding slot 28 to a following 28 may not be drawn radially-inward along the side of the windings in the preceding coil.

In accordance with the invention, it is intended that the width $W_S$ of each slot 28 be greater than the width of axial thickness $T_F$ of the bounding flanges 26 in order to optimize the space available for depositing coil-turns and minimizing the requirement of plastic material for flanges 26. However, it is also important that the geometry of the bobbin 20 and the cross-over grooves 35, 35' therein be such as to ensure that the transitioning coil wire 22 resides substantially entirely within a cross-over groove 35 or 35' throughout its length for the reasons stated earlier. This characteristic must also be ensured during the so-called "worst-case" winding condition, depicted in FIG. 3, in which the supply of wire 22 to the bobbin 20 during the winding operation is longitudinally or axially offset relative to the bobbin to such extent that the wire is forced into engagement with the axially-interior wall of the opposite or facing flange 26 which defines that slot 28.

Figure 3:
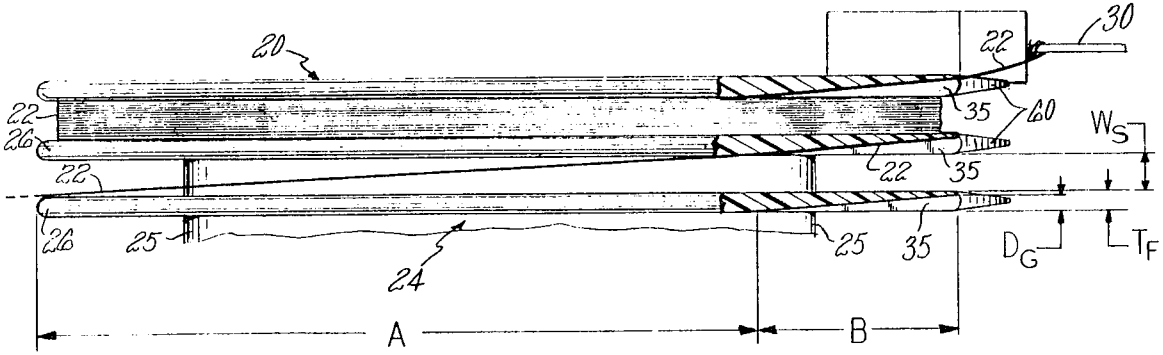
FIG. 3 is a new of the coil assembly, partly in section, taken along line 3—3 of FIG. 1.
Figure 4:
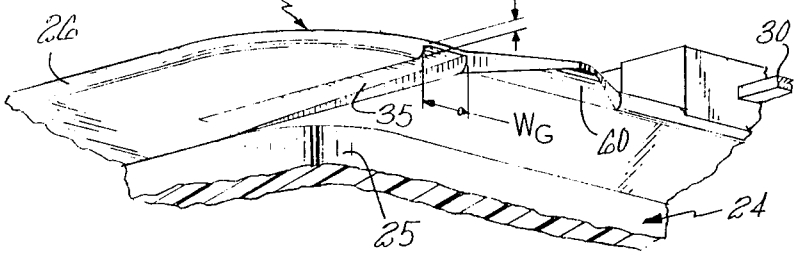
FIG. 4 is a fragmentary perspective view, partly in section, of the coil assembly of FIG. 1 showing a cross-over groove.

It will now be noted that the length, or extent, of a cross-over groove 35 or 35', represented by the dimension B in FIG. 3, is relatively short when compared with the remaining distance A, measured from the point of coincidence of that groove with the spindle 24 to the point of contact of the wire 22 with the opposite flange 26 as it is fed from an offset supply reel. This being the case, the depth $D_G$ of cross-over groove 35 or 35' at its outermost end need not be particularly great in order to ensure that the transitioning wire 22 lies entirely within the groove to its point of coincidence with the spindle 24, even for a significant width $W_S$ to the corresponding slot 28. Because the depth $D_G$ of slot 35 or 35' needn't be particularly great, the thickness $T_F$ of the corresponding flange 26 in which that groove 35 is formed may also be relatively small.

As depicted in FIG. 3, it is only necessary that the fraction, or relationship, $$\frac{D_G + W_S}{A + B}$$

be greater than the relationship, or fraction, $$\frac{W_S}{A}.$$

Such relationship in effect ensures that a transitioning wire 22 is forced to lie entirely within a groove 35, 35' throughout its length, even under a "worst-case" winding condition.

To facilitate the transitioning of coil wire 22 from one slot to the next during the winding operation, lobes or guide ridges 60 and 60' are positioned adjacent the entry to cross-over grooves 35 and 35', respectively. The guide ridges 60 and 60' are positioned angularly, or circumferentially, of the flange 26 to that side of the respective groove 35 or 35' from which a transitioning coil wire 22 is entering. The guide ridges 60, 60' are smoothly-contoured lobes which extend radially outward from a respective flange 26 and aid in guiding the coil wire 22 into a respective cross-over groove 35, 35'.

Figure 5:
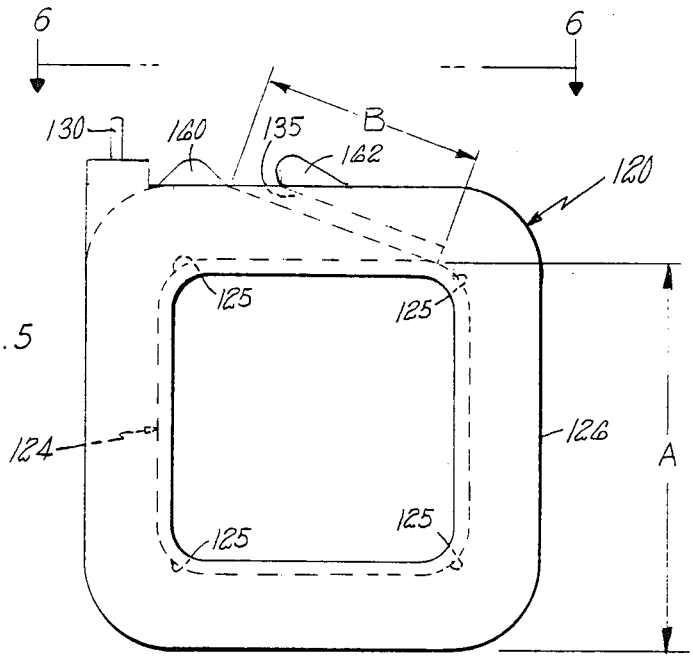
FIG. 5 is a top view of a second embodiment of the coil the invention.
Figure 6:
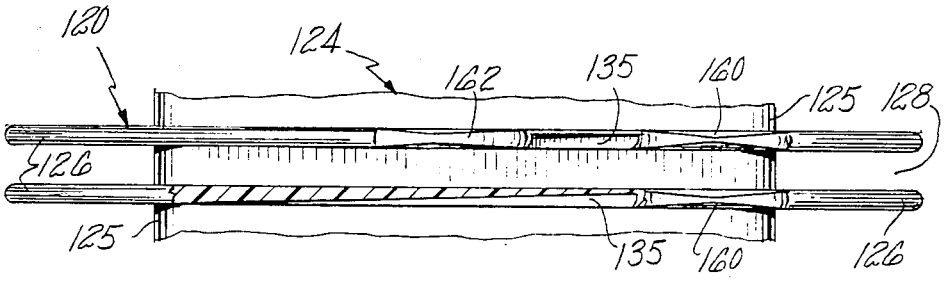
FIG. 6 is a view of the coil assembly taken along line 6—6 of FIG. 5.

Referring to FIGS. 5 and 6, the invention is depicted in the context of a second embodiment in which the bobbin 120 is similar to the bobbin 20 of FIGS. 1–4 in that it includes a spindle 124 of rectangular or square cross section having four corners 125 connected by respective planar surfaces as the perimeter. Moreover, bobbin 120 includes rectilinear flanges 126 extending transversely, or radially, from the spindle 125 and axially spaced from one another to define slots 128 therebetween. Bobbin 120 does reveal, however, that the cross-over groove 135 formed in the axially inner surface of successive flanges 126 may be oriented somewhat differently than the cross-over groove 35 in bobbin 20. Specifically, while cross-over groove 135 remains oriented such that it extends tangent to the perimeter of the spindle 124 and is coincident therewith substantially at a corner 125, the groove need not extend in a direction which parallels one of the planar surfaces of the spindle 124. Such change in orientation may be desirable for the purpose of facilitating the transitioning entry of a coil wire 22 from one slot into the next. For instance, the orientation of cross-over groove 135 in FIG. 5 subjects a transitioning coil wire 22 to a shallower angle at the region of cross-over than does the earlier embodiment, thereby possibly lessening stress in that region. It will also be understood by reference to FIG. 5 that the increased length of cross-over groove 135, as represented by the dimension B, concomitantly indicates the need for a relatively narrowed width to slots 128 and/or an increased thickness to flanges 126 to accommodate a corresponding increase in the depth of the grooves 135.

Because of complexities introduced in the molding operation by the inclining of a cross-over groove 135 relative to the four normal planes of the rectangular spindle 124, the bobbin 120 has not been provided with a further cross-over groove analogous to groove 35' in FIG. 1 which would permit winding in the opposite direction. Further, because the entry to the cross-over groove 135 is relatively to the left of center as depicted in FIG. 5, a pair of lobes or guide ridges 160 and 162 are positioned adjacent the entry to the cross-over groove on angularly-opposite sides thereof. While guide ridge 160 is analogous to guide ridge 60 in the FIG. 1 embodiment, the secondary guide ridge 162 is added for the purpose of ensuring that the transitioning coil wire 122 is caused to enter the cross-over groove 135 rather than being pulled relatively rightward along the outer periphery of a flange 126 without entering the groove 135. A tie-off terminal 130 is mounted on each of the end flanges 126 near the entry to the cross-over groove 135.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. In a coil assembly including a bobbin and a multi-turn winding of coil wire disposed on the bobbin, the bobbin including a central spindle and a plurality of axially-spaced annular flanges extending outward from the spindle to define a plurality of respective slots between facing surfaces of adjacent pairs of said flanges and the winding being disposed in multiple layers in the respective said slots on the bobbin and being continuous between successive said slots in which it is disposes, one flange of each pair of said flanges between which the winding is disposed including a cross-over groove formed in the facing surface thereof for receiving the coil wire which transitions from one said slot to another, the diameter of the coil wire being much less than the axial width of a said slot, said cross-over groove being directly axially open to the slot into which the coil wire is transmitting and being of a width and depth in the respective said flange such as to receive the full diameter of the coil wire therewith throughout the extent of said groove while also preventing the separating function of the flange, thereby to minimize or prevent contact of the coil wire transitioning into a slot with the radially-outward windings in the respective slot and with the radially inward windings in the slot from which it is transitioning, the improvement wherein;

the bobbin spindle is of rectangular cross section having an outer perimeter including four axially-extending corners, the perimeter of said bobbin spindle being substantially planar between successive said corners, the contour of the perimeter of the respective said flanges conforming substantially to the perimeter of said bobbin spindle, the axial thickness of respective said flanges being less than said axial width of respective said slots, the respective said cross-over grooves extending inward form a position near the radially-outer edge of the respective said flange in a direction substantially coplanar with said planar bobbin spindle perimeter at a said corner and to a position of substantial coincidence with said bobbin spindle the respective said cross-over grooves being positioned to be of minimal possible extent from the perimeter of the flange to said coincidence with said bobbin spindle, the remaining geometry and positioning of said cross-over grooves relative to the geometry of the respective said flanges being such that the transitioning coil wire necessarily lies within the respective said groove for substantially the full length of said groove, and wherein each said flange which includes a said cross-over groove formed in the facing surface thereof further includes a second said cross-over groove formed in said facing surface thereof thereby to provide a pair of said cross-over grooves in said flange, said pair of cross-over grooves being disposed for substantial coincidence with said bobbin spindle substantially at a respective pair of adjacent ones of said corners thereby to facilitate coil winding in either of two opposite directions.

2. The coil assembly of claim 1 wherein each said flange which separates one said slot from another includes at least one radially-outwardly extending ridge adjacent each respective said cross-over groove at the radially-outer end of a respective said flange, thereby for guiding the coil wire in its transition out of one said slot and into the respective said cross-over groove in the next said slot.

3. The coil assembly of claim 2 wherein each ridge disposed, angularly of said bobbin, to that side of a respective said cross-over groove from which a transitioning coil wire is coming.

* * * * *